US008443875B2

(12) United States Patent
Lee

(10) Patent No.: US 8,443,875 B2
(45) Date of Patent: May 21, 2013

(54) DOWN HOLE TOOL WITH ADJUSTABLE FLUID VISCOSITY

(75) Inventor: Arley G. Lee, Katy, TX (US)

(73) Assignee: Smith International, Inc., Houston, TX (US)

( * ) Notice: Subject to any disclaimer, the term of this patent is extended or adjusted under 35 U.S.C. 154(b) by 540 days.

(21) Appl. No.: 12/175,299

(22) Filed: Jul. 17, 2008

(65) Prior Publication Data

US 2009/0025928 A1 Jan. 29, 2009

Related U.S. Application Data

(60) Provisional application No. 60/951,869, filed on Jul. 25, 2007.

(51) Int. Cl.
*E21B 31/113* (2006.01)
*E21B 10/32* (2006.01)

(52) U.S. Cl.
USPC ..... 166/66.5; 175/267; 175/293; 175/407

(58) Field of Classification Search
USPC ..... 166/66.5, 65.1, 249; 175/384, 407, 175/267, 293
See application file for complete search history.

(56) References Cited

U.S. PATENT DOCUMENTS

| | | | | |
|---|---|---|---|---|
| 6,257,356 | B1 * | 7/2001 | Wassell | 175/61 |
| 6,732,817 | B2 | 5/2004 | Dewey et al. | |
| 7,036,612 | B1 * | 5/2006 | Raymond et al. | 175/321 |
| 7,082,078 | B2 * | 7/2006 | Fripp et al. | 367/83 |
| 7,219,752 | B2 * | 5/2007 | Wassell et al. | 175/321 |
| 2002/0084224 | A1 * | 7/2002 | Tovar De Pablos et al. | 210/695 |
| 2002/0108747 | A1 | 8/2002 | Dietz et al. | |
| 2003/0019622 | A1 * | 1/2003 | Goodson et al. | 166/66.5 |
| 2003/0166470 | A1 * | 9/2003 | Fripp et al. | 507/100 |
| 2004/0112594 | A1 * | 6/2004 | Aronstam et al. | 166/249 |
| 2006/0243489 | A1 | 11/2006 | Wassell et al. | |
| 2007/0221408 | A1 * | 9/2007 | Hall et al. | 175/57 |
| 2007/0289778 | A1 * | 12/2007 | Watkins et al. | 175/40 |

FOREIGN PATENT DOCUMENTS

| | | |
|---|---|---|
| GB | 2050466 | 1/1981 |
| GB | 2385871 | 9/2003 |
| GB | 2396178 | 6/2004 |
| GB | 2443362 | 4/2008 |
| GB | 2451345 A | 1/2009 |

OTHER PUBLICATIONS

Combined Search and Examination Report for Application GB0813583.2, dated Aug. 22, 2008, 8 pages.

"Laboratory Testing of an Active Drilling Vibration Monitoring & Control System"; Martin E. Cobern & Mark E. Wassell; Apr. 2005 (14 pages).

* cited by examiner

*Primary Examiner* — Kenneth L Thompson
(74) *Attorney, Agent, or Firm* — Osha • Liang LLP

(57) ABSTRACT

A down hole tool includes a tool body, a fluid cavity, a magnetorheological fluid disposed in the fluid cavity, and an electrical control unit in communication with the MR fluid. The electrical control unit is configured to adjust a viscosity of the MR fluid by varying a magnetic field.

13 Claims, 3 Drawing Sheets

DOWN HOLE TOOL WITH ADJUSTABLE FLUID VISCOSITY

BACKGROUND OF INVENTION

1. Field of the Invention

The invention relates generally to down hole tools having fluid with an adjustable viscosity, and, more specifically, to down hole tools using magnetic fields to adjust the viscosity of a magnetorheological fluid.

2. Background Art

Many down hole tools used in drilling for hydrocarbons and for servicing existing wellbores to aid hydrocarbon recovery include oil or other viscous fluid to control actuation of the down hole tool. One such down hole tool is a jar.

Jars are used during drilling and fishing operations to free other components of a drill string that have gotten stuck in the wellbore. Jars provide an impact blow in the up or down directions. A driller can control the jarring direction, impact intensity, and jarring times from the rig floor. The magnitude and direction of the load used to initiate the impact blow achieve this control.

FIGS. 1A and 1B show cross sections through a detent portion 11 of a prior art jar 10. To jar upward, the drill string is pulled in tension. Upward force arrow 13 is shown applied to a mandrel 12 of the jar 10. This force is transmitted to outer cylindrical housing 14 by a resulting increase in pressure in the hydraulic fluid that is contained in the upper chamber 16 between the outer cylindrical housing 14 and the mandrel 12.

The magnitude of pressure in the upper chamber 16 is directly proportional to the magnitude of the force applied to the mandrel 12 by pulling the drill string upward. This high-pressure fluid is allowed to flow through an orifice 18 to a lower chamber 20. A check valve (not shown) is sometimes used to restrict the flow through the orifice 18. The result of this fluid flow is a relative axial movement between the outer housing 14 and the mandrel 12. This axial movement occurs slowly until the orifice 18 is in juxtaposition to a relief area 17 of outer housing 14, which causes a sudden release of high pressure to occur as the fluid flow is no longer restricted by the orifice 18. The sudden release of high pressure results in an impact below being delivered to the "knocker" part (not shown) of the jar as the tension in the drill string is released. The knocker is normally located at the upper most end of the jar.

During the restricted flow of the hydraulic fluid, the temperature increases as a result of the high pressures and friction through the orifice 18. Temperature also increases from being down hole, which is typically much hotter than surface temperatures. The increasing temperature reduces the viscosity of the hydraulic fluid, which allows flow through the orifice 18 to occur faster. The faster flow reduces the amount of time it takes to fire off the jar. With successive firings, the viscosity can be reduced so much that there is insufficient time to pull the drill string in tension before the jar fires again. This causes successive jar firings to be weaker each time until becoming completely ineffective.

To compensate for the increased temperature down hole, the viscosity of the hydraulic fluid may be made to be higher during assembly of the jar. The process of adjusting viscosity at the surface typically involves mixing oils of different viscosity. The selected viscosity is also based on the desired timing for the jar between initial loading and firing. Regardless of adjustments made at the surface, each successive firing of the jar will continue to warm up the hydraulic fluid until the viscosity decreases so much that the jar becomes ineffective. In many cases, the jarring operation will successfully unstick the drill string before the hydraulic fluid gets too hot, but in other cases the jarring operation will have to be stopped before success is achieved in order to replace or rebuild the jar.

This issue is not limited to jars, but rather may occur with any tool that interacts with hydraulic fluid, such as downhole shock (absorber) tools, accelerators, and other tools known to those of ordinary skill in the art.

SUMMARY OF INVENTION

In one aspect, embodiments disclosed herein relate to a down hole tool having a tool body, a fluid cavity, a magnetorheological fluid disposed in the fluid cavity, and an electrical control unit in communication with the MR fluid. The electrical control unit is configured to adjust a viscosity of the MR fluid by varying a magnetic field In another aspect, embodiments disclosed herein relate to a method of controlling a down hole tool, the method including measuring a temperature of a magnetorheological fluid disposed in a fluid cavity of the down hole tool and adjusting a magnetic field in response to the measured temperature such that a predetermined viscosity of the MR fluid is substantially maintained.

Other aspects and advantages of the disclosure will be apparent from the following description and the appended claims.

DETAILED DESCRIPTION

Embodiments disclosed herein are related generally to down hole tools having fluid with an adjustable viscosity, and, more specifically, to down hole tools using magnetic fields to adjust the viscosity of a magnetorheological (MR) fluid.

MR fluids are fluids that contain suspended magnetizable-particles. The carrier fluid for the suspended magnetizable-particles can be any of various fluids, including hydrocarbon-based, water-based, and silicone-based. As the name suggests, the rheological properties of MR fluids change depending on whether a magnetic field is present and the strength of the magnetic field. In particular, the apparent viscosity of the MR fluid can be controlled by modulating the magnetic field. MR fluids are commercially available from, for example, Lord Corporation (Cary, N.C.).

The magnetorheological response of MR fluids results from the polarization induced in suspended particles by the magnetic field. The interaction between the resulting induced dipoles causes the suspended particles to form columnar structures, parallel to the applied field. These chain-like structures restrict the motion of the fluid, thereby increasing the viscous characteristics of the suspension. The mechanical energy needed to yield the microstructure increases as the applied magnetic field increases resulting in a field dependent yield stress. In other words, the MR fluid becomes more resistant to flow (i.e. more viscous) in response to a stronger magnetic field. In the presence of the magnetic field, the MR fluid is generally represented as a Bingham plastic having a variable yield strength, with the flow governed by the following equation.

$$\tau=\tau_y(H)+\eta\dot{\gamma},\ \tau<\tau_y$$

Where $\tau_y$ is the field dependent yield stress, H is the magnetic field, $\dot{\gamma}$ is the fluid shear rate, and $\eta$ is the plastic viscosity of the MR fluid in the absence of any magnetic field.

Figure 1A:
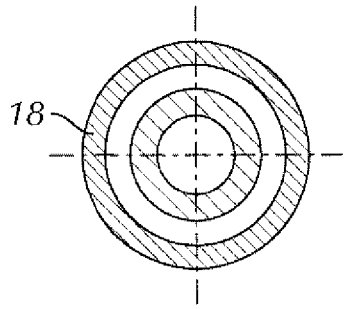
FIGS. 1A and 1B show cross sections of a prior art jar.
Figure 1B:
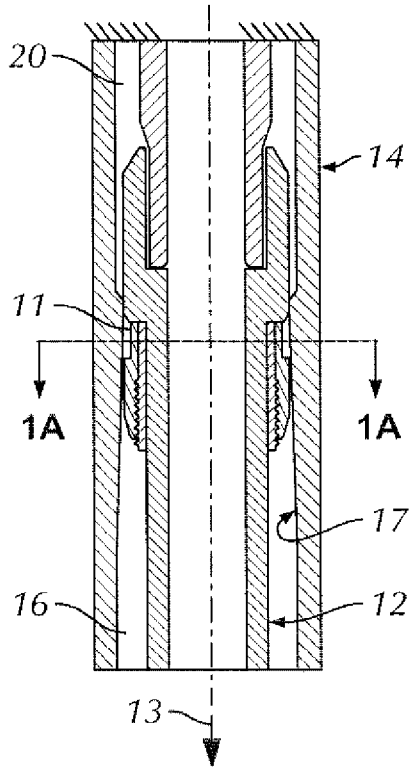
Figure 2:
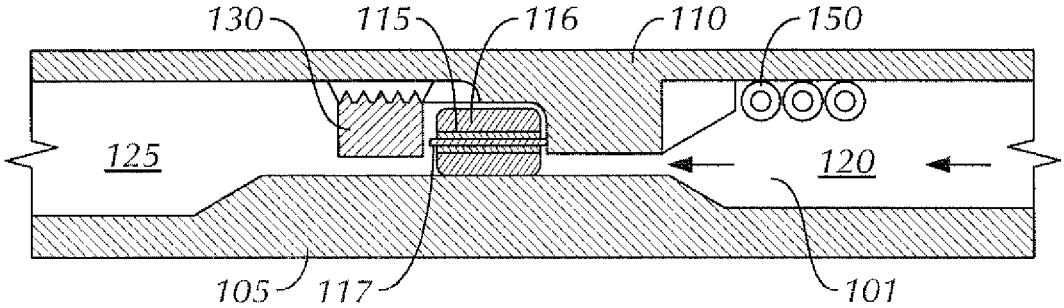
FIG. 2 shows a jar in accordance with an embodiment of the present disclosure.

In FIG. 2, a jar in accordance with an embodiment is shown. In particular, FIG. 2 shows the detent portion of the jar. The annular space between a detent mandrel 110 and a detent cylinder 105 form fluid cavities 120 and 125, which are on opposing sides of a seal 116. The seal 116 may be held in place by a stop ring 130, or any other retention mechanism known in the art. An orifice 115 is provided through the seal 116. The fluid cavities 120 and 125 contain the hydraulic fluid for the jar, which is MR fluid 101. An electrical control unit 150 is provided in the fluid cavity 120. The electrical control unit 150 is configured to provide an adjustable magnetic field, which in turn controls the viscosity of the MR fluid 101. In one embodiment, the electrical control unit 150 includes electric coils, a temperature sensor, and a control box for setting the electrical control unit 150. Those having ordinary skill in the art will appreciate that the location of the electrical control unit 150 may vary without departing from the scope of the embodiments disclosed herein so long as the electrical control unit 150 is able to vary the magnetic field where the MR fluid flows between the fluid cavities.

When the jar is pulled in tension, the MR fluid 101 flows from the fluid cavity 120 through the orifice 115 to the fluid cavity 125. A meter pin 117 restricts the flow through the orifice 115 by partially blocking the orifice 115. The radial gap between the meter pin 117 and the orifice 115 partially determines the delay time between the initial pull of the jar and the firing of the jar. The other factors in the delay time include viscosity of the MR fluid 101 and the tension in the jar, which affects the pressure differential between the fluid cavities 120 and 125. The equation for the flow rate between the fluid cavities 120 and 125 (annular flow around the meter pin 117 through the orifice 115) is:

$$Q=\pi*d*b\hat{}3*\Delta P/(12*\mu*l)$$

Where "d" is the diameter of the meter pin 117, "b" is the radial dimension of the gap between the meter pin 117 and the orifice 115, "l" is the length of the orifice 115, $\mu$ is the viscosity of the MR fluid 101 in centipoise (cps), and $\Delta P$ is the pressure differential between the fluid cavities 120 and 125.

From the flow rate, the delay time can be calculated for the jar. During use of the jar, the temperature of the MR fluid increases, which decreases the viscosity of the carrier fluid component of the MR fluid absent a magnetic field. The reduced viscosity causes the flow rate for a given pressure differential to increase, which proportionally decreases the delay time. This reduced viscosity may be offset by varying the magnetic field provided by the electrical control. In one embodiment, the temperature sensor monitors the temperature of the MR fluid and provides a magnetic field that increases the viscosity of the MR fluid to offset the reduced viscosity of the carrier fluid, thereby keeping the viscosity of the MR fluid substantially constant. By compensating for the temperature increase, the viscosity of the MR fluid may be substantially constant during the use of the jar, which in turn provides a substantially constant delay time for the firing of the jar.

Those having ordinary skill in the art will appreciate that the manner in which the appropriate strength of the magnetic field is determined may vary without departing from the scope of the disclosure. In one embodiment, the temperature of the MR fluid is monitored as disclosed above. From the measured temperature, the electrical control unit will adjust the magnetic field to compensate for any decrease in viscosity from the change in temperature. The electrical control unit may include the ability to store data concerning the correlation between temperature and viscosity for the particular MR fluid. Using this data, the electrical control unit may maintain a predetermined viscosity for the MR fluid. The electrical control unit may further include the ability to input a predetermined delay time or a predetermined flow rate. Data may be input before the jar is placed in the wellbore. Alternatively, or in addition, the jar may include a telemetry system to allow control of the electrical control unit from the surface during use.

Using the equation for the flow rate between the fluid cavities, other variables besides temperature may be monitored by the electrical control unit to determine the adjustment to the magnetic field. For example, in one embodiment, the flow rate may be monitored and kept constant. The tension in the jar, which correlates with the pressure differential between the fluid cavities, may also be monitored. The need to increase or decrease the viscosity of the MR fluid may be determined by detecting an increase in the flow rate relative to the tension (and its associate pressure differential). If the flow rate increases, the electrical control unit can increase the strength of the magnetic field until the flow rate decreases. By monitoring and controlling the flow rate, the delay time can be kept substantially constant. The relative movement between the detent mandrel and the detent cylinder may be similarly monitored because the movement corresponds to flow rate and delay time.

Figure 3:
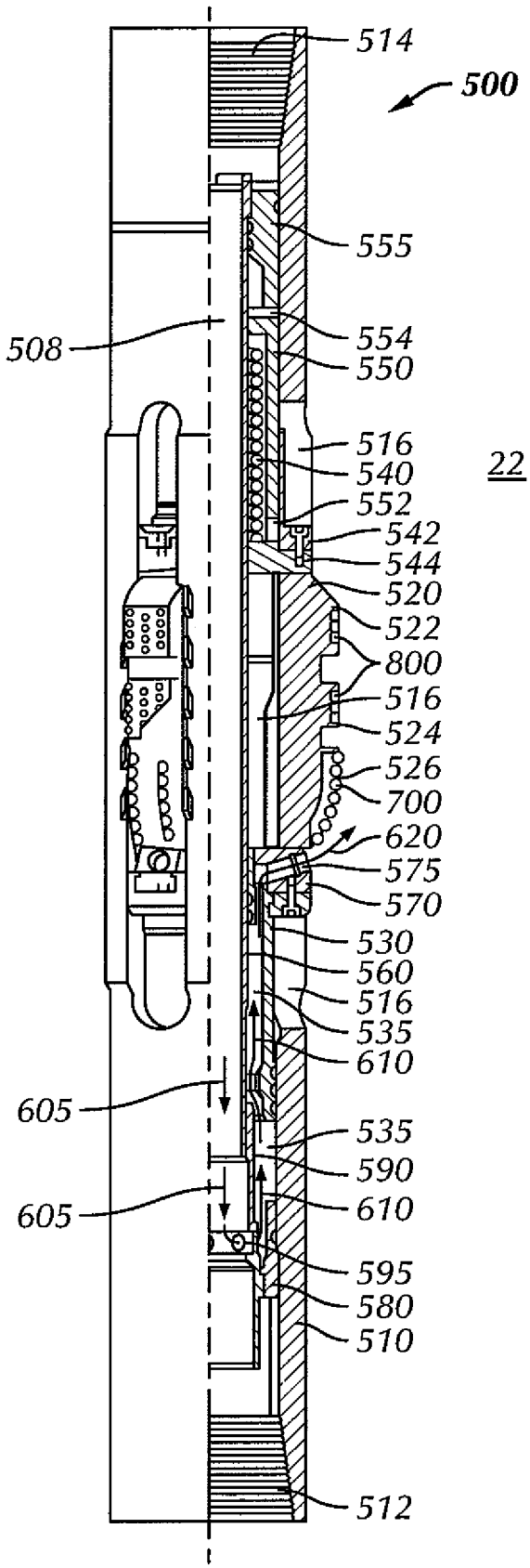
FIG. 3 shows an underreamer in accordance with an embodiment of the present disclosure.

In other embodiments, an MR fluid may be used in a variety of other drilling tools. For example, in one embodiment, an MR fluid may be used in an extendable tool, such as an underreamer, such as disclosed in U.S. Pat. No. 6,732,817, assigned to the assignee of the present invention. In that patent, and as shown in FIG. 3, the expandable tool 500 comprises a generally cylindrical tool body 510. The tool body 510 includes upper 514 and lower 512 connection portions for connecting the tool 500 into a drilling assembly. In approximately the axial center of the tool body 510, one or more pocket recesses 516 are formed in the body 510 and spaced apart azimuthally around the circumference of the body 510. The one or more recesses 516 accommodate the axial movement of several components of the tool 500 that move up or down within the pocket recesses 516, including one or more moveable, non-pivotable tool arms 520.

Each recess 516 stores one moveable arm 520 in the collapsed position. The preferred embodiment of the expandable tool includes three moveable arms 520 disposed within three pocket recesses 516. In the discussion that follows, the one or more recesses 516 and the one or more arms 520 may be referred to in the plural form, i.e. recesses 516 and arms 520. Nevertheless, it should be appreciated that the scope of the present invention also comprises one recess 516 and one arm 520. In this embodiment, the MR fluid can be used to control the expanding arm, namely by locking/controlling the rate of expansion and/or interaction to reaming activity.

As in the previous embodiment, this result can be accomplished by providing the hydraulic fluid for the underreamer, which is MR fluid, and an electrical control unit in a fluid cavity. The electrical control unit is configured to provide an adjustable magnetic field, which in turn controls the viscosity of the MR fluid. In one embodiment, the electrical control unit includes electric coils, a temperature sensor, and a control box for setting the electrical control unit. Those having ordinary skill in the art will appreciate that the location of the electrical control unit may vary without departing from the scope of the embodiments disclosed herein so long as the electrical control unit is able to vary the magnetic field where the MR fluid flows between the fluid cavities.

The recesses 516 further include angled channels that provide a drive mechanism for the moveable tool arms 520 to move axially upwardly and radially outwardly into the expanded position of FIG. 3. A biasing spring 540 is preferably included to bias the arms 520 to a collapsed position. The biasing spring 540 is disposed within a spring cavity and is covered by a spring retainer 550. Retainer 550 is locked in position by an upper cap 555. A stop ring 544 is provided at the lower end of spring 540 to keep the spring 540 in position.

Below the moveable arms 520, a drive ring 570 is provided that includes one or more nozzles 575. An actuating piston 530 that forms a piston cavity 535, engages the drive ring 570. A drive ring block connects the piston 530 to the drive ring 570 via bolt. The piston 530 is adapted to move axially in the pocket recesses 516. A lower cap 580 provides a lower stop for the axial movement of the piston 530. An inner mandrel 560 is the innermost component within the tool 500, and it slidingly engages a lower retainer 590.

A threaded connection is provided between the upper cap 555 and the inner mandrel 560 and between the upper cap 555 and body 510. The upper cap 555 may sealingly engage the body 510 and the inner mandrel 560. A wrench slot 554 is provided between the upper cap 555 and the spring retainer 550, which provides room for a wrench to be inserted to adjust the position of the spring retainer 550 in the body 510. Spring retainer 550 connects via threads to the body 510. Towards the lower end of the spring retainer 550, a bore 552 is provided through which a bar may be placed to prevent rotation of the spring retainer 550 during assembly. For safety purposes, a spring cover 542 may be bolted adjacent to the stop ring 544. The spring cover 542 may then prevent personnel from incurring injury during assembly and testing of the tool 500.

The moveable arms 520 include pads 522, 524, and 526 with structures 700, 800 that engage the borehole when the arms 520 are expanded outwardly to the expanded position of the tool 500 shown in FIG. 3. Below the arms 520, the piston 530 may sealingly engage the inner mandrel 560 and the body 510. A sealing engagement may also be provided between the lower cap 580 and the body 510. The lower cap 580 is threadingly connected to the body 510 and the lower retainer 590. The lower cap 580 provides a stop for the piston 530 to control the collapsed diameter of the tool 500.

Several components are provided for assembly rather than for functional purposes. For example, the drive ring 570 is coupled to the piston 530, and then a drive ring block may be boltingly connected to prevent the drive ring 570 and the piston 530 from translating axially relative to one another. The drive ring block, therefore, may provide a locking connection between the drive ring 570 and the piston 530.

FIG. 3 depicts the tool 500 with the moveable arms 520 in the maximum expanded position, extending radially outwardly from the body 510. In the expanded position shown in FIG. 3, the arms 520 will either underream the borehole or stabilize the drilling assembly, depending upon how the pads 522, 524 and 526 are configured. In the configuration of FIG. 3, cutting structures 700 on pads 526 would underream the borehole. Wear buttons 800 on pads 522 and 524 would provide gauge protection as the underreaming progresses. The MR fluid force may cause the arms 520 to expand outwardly to the position shown in FIG. 3.

As the piston 530 moves axially upwardly in pocket recesses 516, the piston 530 engages the drive ring 570, thereby causing the drive ring 570 to move axially upwardly against the moveable arms 520. The arms 520 will move axially upwardly in pocket recesses 516 and also radially outwardly as the arms 520 travel in channels 518 disposed in the body 510. In the expanded position, the flow continues along paths 605, 610 and out into the annulus 22 through nozzles 575. Because the nozzles 575 are part of the drive ring 570, they move axially with the arms 520. Accordingly, these nozzles 575 are optimally positioned to continuously provide cleaning and cooling to the cutting structures 700 disposed on surface 526 as fluid exits to the annulus 22 along flow path 620.

Figure 4:
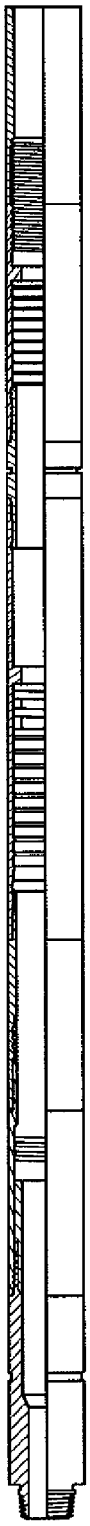
FIG. 4 shows a shock absorber in accordance with an embodiment of the present disclosure.

In yet another embodiment, MR fluids in accordance with embodiments of the present invention may be useful in downhole shock absorber tools, whereby the MR fluid could be used to provide a variable damping factor to the tool. As is known to those in the art, shock absorber tools may be used to absorb and dampen variable axial loads produced during normal drilling operations. This may be useful in specific applications, such as when the absorption needs to be tailored to specific parameters, which may be predicted in advance, using suitable simulation technology, for example. In particular, the viscosity properties could be tailored to meet the specific needs of a given drilling application. For example, in a specific embodiment, such as that shown in FIG. 4, which shows a shock absorber tool sold under the name Hydra-Shock®, by Smith International, Inc. (Houston, Tex.), an MR fluid may be used to drive a floating piston.

Figure 5:
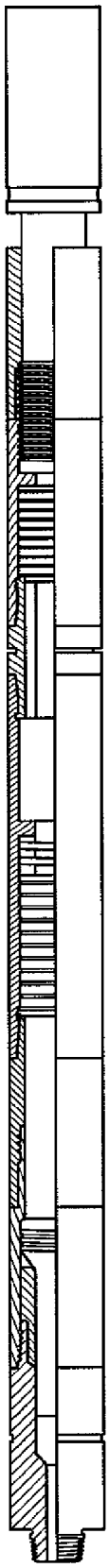
FIG. 5 shows a vibrational dampening tool in accordance with an embodiment of the present disclosure.

Further, in yet another embodiment, MR fluids in accordance with embodiments of the present disclosure may be useful in downhole vibrational dampening tools, whereby the MR fluid could be used to provide a variable dampening factor to the tool. As is know to those in the art, vibrational dampening tools may be used to dampen, absorb, and/or control both rotational and axial vibrational loads produced during normal drilling operations. This may be useful in specific applications, such as when dampening and absorption needs to be tailored to specific vibrational parameters, which may also be predicted in advance using, for example, simulation technology. For example, in a specific embodiment, such as that shown in FIG. 5, which shows a vibrational dampening tool sold under the name Hydra-Torax®, by Smith International, Inc. (Houston, Tex.), an MR fluid may be used to drive portions thereof.

Furthermore, those having ordinary skill in the art will appreciate that MR fluids in accordance with embodiments of the present invention may be used in a number of other applications as well, such as with an actuator. Specifically, in one embodiment, MR fluids may be used with a Double-Acting Hydraulic Actuator (DACCH), sold by Smith International, Inc. (Houston, Tex.).

Conserving power may be important if the down hole tool is powered by a battery source. In one embodiment, to conserve power, the electrical control unit may provide the magnetic field only when the down hole tool is in use. For example, in the case of the jar containing the MR fluid, the magnetic field may be initiated upon sensing the start of fluid flow between the fluid cavities. Because the change in rheological properties is nearly instantaneous upon application of the magnetic field, the delay time can still be fully controlled while conserving power. Those having ordinary skill in the art will appreciate that the electrical control unit may be powered by other sources besides batteries without departing from the scope of the disclosure. For example, a turbine may provide power to the electrical control unit. Also, power may be transmitted through the drill string using wired drill pipe.

The use of MR fluids in one or more of the above embodiments can provide a solution to varying viscosity of fluids as a result of down hole conditions, including temperature increases caused by tool usage and a high down hole temperature. In the jar embodiment, the delay time can be kept substantially constant regardless of the temperature of the MR fluid. Similar predictability of timing may be obtained for other down hole tools as well.

By providing an adjustable viscosity, the setup time for the down hole tool can be reduced. In particular, during assembly of down hole tools, the desired viscosity of the hydraulic fluid is conventionally obtained through careful mixing of oils in anticipation of a reduced viscosity down hole. In the above-described embodiments, a single MR fluid can used for a range of temperature conditions. The electrical control unit can then control the viscosity of the MR fluid to compensate for variations in temperature during use.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the present disclosure should be limited only by the attached claims.

What is claimed is:

1. A down hole tool comprising:

a tool body;

one or more operative pairs of fluid cavities, wherein each pair has a seal disposed between the individual cavities;

a magnetorheological (MR) fluid disposed in one of the fluid cavities;

an electrical control unit disposed in one of the fluid cavities and in communication with the MR fluid, wherein the electrical control unit varies a magnetic field to adjust viscosity of the MR fluid within the respective fluid cavity; and a temperature sensor, wherein the electrical control unit is configured to vary the magnetic field in response to a measured temperature of the MR fluid.

2. The down hole tool claim 1, further comprising:

a flow rate sensor, wherein the electrical control unit is configured to vary the magnetic field in response to a measured flow rate of the MR fluid.

3. The down hole tool of claim 1, wherein the down hole tool is a jar comprising a detent portion, and wherein the seal comprises an orifice through which the MR fluid flows between the two fluid cavities.

4. The down hole jar of claim 3, wherein a meter pin is disposed in the orifice.

5. The down hole tool of claim 1, wherein the tool comprises at least one of an underreamer, a shock absorber, and a vibrational dampener.

6. A method of controlling a down hole tool, comprising:

taking a measurement with a sensor of a magnetorheological (MR) fluid, the MR fluid disposed in one of a pair of fluid cavities of the down hole tool;

providing a magnetic field with an electrical control unit, based upon the measurement, wherein the electrical control unit is disposed in one of the pair of fluid cavities; and varying the magnetic field to adjust a viscosity of the MR fluid within the respective fluid cavity.

7. The method of claim 6, wherein the sensor comprises a temperature sensor, and wherein the magnetic field is varied based upon a measured temperature of the MR fluid.

8. The method of claim 6, wherein the sensor comprises a flow rate sensor, wherein the magnetic field is varied based upon a measured flow rate of the MR fluid.

9. A method of controlling a down hole tool, comprising:

measuring a temperature of a magnetorheological (MR) fluid, the MR fluid disposed in one of a pair of fluid cavities of the down hole tool;

providing a magnetic field with an electrical control unit, wherein the electrical control unit is disposed in one of the pair of fluid cavities and is in communication with the MR fluid;

varying the magnetic field in response to the measured temperature such that a predetermined viscosity of the MR fluid is substantially maintained within the fluid cavity.

10. A down hole tool comprising:

a tool body;

one or more operative pairs of fluid cavities, wherein each pair has a seal disposed between the individual cavities;

a magnetorheological (MR) fluid disposed in one of the fluid cavities;

a flow rate sensor, and an electrical control unit disposed in one of the fluid cavities and in communication with the MR fluid;

wherein the electrical control unit varies a magnetic field to adjust viscosity of the MR fluid within the respective fluid cavity; and wherein the electrical control unit is configured to vary the magnetic field in response to a measured flow rate of the MR fluid.

11. A down hole tool comprising:

a tool body;

one or more operative pairs of fluid cavities, wherein each pair has a seal disposed between the individual cavities;

a magnetorheological (MR) fluid disposed in one of the fluid cavities; and an electrical control unit disposed in one of the fluid cavities and in communication with the MR fluid, wherein the electrical control unit varies a magnetic field to adjust viscosity of the MR fluid within the respective fluid cavity;

wherein the down hole tool is a jar comprising a detent portion, and wherein the seal comprises an orifice through which the MR fluid flows between the two fluid cavities.

12. The down hole jar of claim 11, wherein a meter pin is disposed in the orifice.

13. A down hole tool comprising:

a tool body;

one or more operative pairs of fluid cavities, wherein each pair has a seal disposed between the individual cavities;

a magnetorheological (MR) fluid disposed in one of the fluid cavities; and an electrical control unit disposed in one of the fluid cavities and in communication with the MR fluid, wherein the electrical control unit varies a magnetic field to adjust viscosity of the MR fluid within the respective fluid cavity; and wherein the tool comprises at least one of an underreamer, a shock absorber, and a vibrational dampener.

* * * * *